US009167873B2

(12) United States Patent
May

(10) Patent No.: US 9,167,873 B2
(45) Date of Patent: Oct. 27, 2015

(54) CANTILEVER PARASOL

(71) Applicant: May Geraetebau GmbH, Betzenweiler (DE)

(72) Inventor: Karl-Heinz May, Betzenweiler (DE)

(73) Assignee: May Geraetebau GmbH, Betzenweiler (DE)

( * ) Notice: Subject to any disclaimer, the term of this patent is extended or adjusted under 35 U.S.C. 154(b) by 283 days.

(21) Appl. No.: 13/651,528

(22) Filed: Oct. 15, 2012

(65) Prior Publication Data

US 2013/0092200 A1 Apr. 18, 2013

(30) Foreign Application Priority Data

Oct. 13, 2011 (DE) ..... 10 2011 115 815

(51) Int. Cl.
*A45B 23/00* (2006.01)

(52) U.S. Cl.
CPC ..... *A45B 23/00* (2013.01); *A45B 2023/005* (2013.01); *A45B 2023/0043* (2013.01); *A45B 2023/0056* (2013.01)

(58) Field of Classification Search
CPC ..... A45B 11/00; A45B 2023/0031; A45B 2023/0043; A45B 2023/005; A45B 2023/0056
USPC ..... 135/20.1, 21
See application file for complete search history.

(56) References Cited

U.S. PATENT DOCUMENTS

| | | | | |
|---|---|---|---|---|
| 3,362,419 | A * | 1/1968 | Feyerherm | 135/15.1 |
| 4,606,366 | A | 8/1986 | Collet | |
| 5,263,505 | A * | 11/1993 | Yeom | 135/20.1 |
| 5,927,310 | A * | 7/1999 | Lin | 135/20.1 |
| 6,694,993 | B2 * | 2/2004 | Chou | 135/98 |
| 2006/0054285 | A1 * | 3/2006 | Louis | 160/53 |

FOREIGN PATENT DOCUMENTS

| | | | |
|---|---|---|---|
| EP | 1627577 | | 2/2006 |
| FR | 2731739 | A1 * | 9/1996 |

OTHER PUBLICATIONS

European Search Report for European Patent Application No. 12188378.9 completed Jan. 28, 2013.

* cited by examiner

*Primary Examiner* — David R Dunn
*Assistant Examiner* — Danielle Jackson
(74) *Attorney, Agent, or Firm* — Carlson, Gaskey & Olds, PC

(57) ABSTRACT

A cantilever parasol has a mast, two main arms proceeding laterally from the mast and coupled to each other in a scissors-type manner, and a linkage of bars for supporting a cover. A first main arm extends from an upper mast bearing through a slit in the cover to a vertical arm of the linkage of bars. At least one sealing structure is provided for sealing the slit in the cover.

13 Claims, 5 Drawing Sheets

50,51
W
34
36
18
60
32
42
10

10
28
26
22
26'
24
20
34
A
18
16
14
30
12
32
26'

CANTILEVER PARASOL

RELATED APPLICATION

This application claims priority to German Application No. 10 2011 115 815.8, filed 13 Oct. 2011.

TECHNICAL FIELD

The present invention relates to a cantilever parasol, including a mast, two main arms proceeding laterally from the mast and coupled to each other in a scissors-type manner, and a fold-open linkage of bars that is seated eccentrically of the mast for supporting a cover. A first main arm extends in an opened-up condition of the parasol, from an upper mast bearing through a slit in the cover and obliquely downward to a vertical arm seated in the center of the cover and forms part of the linkage of bars. A second main arm runs from a lower mast bearing below the cover toward the crown thereof.

BACKGROUND

Cantilever parasols have the advantage that the cover, and thus the shading, can be partly positioned at a distinct distance from the mast, so that the area to be shaded is not hindered by the mast. Due to the eccentricity of the load, however, such overhanging parasols need to be designed to be very stable. Here, a system has turned out to be very successful in which two main arms hold the linkage of bars, the main arms extending from the mast laterally outwards and being coupled to each other in a scissors-type manner. Seated centrally in the linkage of bars is the vertical arm from which the individual struts run outwards. The first main arm fitted to the upper end of the mast, however, must run through the cover, which is slitted for this reason. During opening and closing of the parasol, a relative movement occurs between the first main arm and the cover so that the slit needs to have a certain longitudinal extent.

SUMMARY

To further improve a generic cantilever parasol, a cantilever parasol includes at least one sealing structure coupled to at least one of the main arms to seal a slit in the cover. Since water may seep through the slit, it was contemplated to provide brush-like sealing strips on the cover in the region of the slit. This solution, however, is in need of improvement. In contrast thereto, the present invention makes provision for a sealing structure which at least partly covers the slit at least in the fully opened-up condition of the parasol. What is special about the sealing structure is that it, or else part of the sealing structure, is coupled in movement to at least one of the main arms, as a result of which the sealing means or part of it can travel. The relative movement of the two main arms with respect to each other causes the sealing structure or part thereof to be shifted so as to close the overlong slit in the cover as far as possible, but also to open it again; the slit allows the swiveling motion of the main arms relative to each other.

The sealing structure is relatively close to, or even in contact with, the first main arm and closes the slit even when the parasol is not fully opened up since the sealing structure follows the relative movement between the main arm and the cover.

Preferably, the sealing structure is a sealing plate or a zipper that has a slider coupled to one of the main arms, as a result of which the zipper is opened and closed with the movement of the main arm.

The sealing structure is mounted to be guided for sliding motion and is displaced when the parasol is opened or closed. More specifically, the sealing structure is guided for sliding motion on the second main arm, which extends obliquely from below, along the underside of the cover as far as to the crown of the cover (topmost point of the vertical arm). This main arm is stable and, owing to the scissors linkage, runs close to the first main arm, so that sufficient stability is provided for the attachment of the sealing structure.

The sealing structure should in particular be coupled to the first main arm in terms of motion and be displaced by the first main arm being swiveled. This results in a good sealing action to the effect that the slit in the cover is partly penetrated by the first main arm and is closed by the sealing structure at least on one half of the slit.

The sealing structure more particularly runs starting from the point of passage of the first main arm obliquely upward on the slit toward the crown, relating to the fully opened condition of the parasol.

According to one example embodiment, the sealing structure rests permanently against the first main arm. In case a zipper is made use of, the slider rests permanently against the first main arm.

A coupling element that connects the sealing structure with the first main arm serves for the transfer of motion. The coupling element may preferably be designed as a releasable coupling structure to facilitate assembly and disassembly of the parasol. One option in this respect is in that the coupling element is provided in the form of a magnet that ensures the releasable connection between the sealing structure and the first main arm.

The second main arm has an oblong opening, for example, for the first main arm to extend therethrough, resulting in an increased stability of the parasol linkage.

The edges of the slit of the cover may be attached to the second main arm, so that the edges are firmly positioned and will not flap in the wind, and the slit will not gape open. In addition, due to the edges being in a firm position, the slit can be reliably closed since the at least one sealing structure can be attached to the second main arm directly adjacent to or so as to overlap the edges of the cover.

In the preferred embodiment, as mentioned above, the sealing structure is a sealing plate, with a plurality of sealing plates resulting in further advantages as to tightness. A movable sealing plate overlaps with adjacent upper and lower sealing plates, relating to the opened-up condition of the parasol, in particular in an imbricated fashion. This is intended to prevent any gaps from being formed above or below the movable sealing plate, through which water may seep.

Furthermore, the preferred embodiment makes provision that the sealing plate has a slit-shaped lead-through for the first main arm. This means that the sealing plate extends not only directly from the first main arm upward, relating to the opened-up condition of the parasol, but also laterally past the first main arm. The sealing plate may have a U-shape or a rectangular shape with the slit which is surrounded by a continuous edge.

In a different embodiment the sealing structure is a zipper, in particular a toothless zipper, the slider of the zipper being coupled to the second main arm in terms of motion. Preferably, even two sliders are provided, that is, one each on the opposite sides of the first main arm.

The two zipper tapes are attached, e.g., either to the slit edges of the cover or to the second main arm, to which the slit edges are then fitted.

To increase the stability and also to allow swivel angles that are as large as possible, the first main arm has an offset in the region of its swivel axis via which it is connected to the second main arm, so that two parallel arm halves are formed. This offset assists in folding up the parasol as completely as possible and also allows an oblong opening for the first main arm to be formed in the second main arm.

In this context, the two arm halves are connected with each other by a separate coupling piece which has the offset and the swivel axis. In particular, the two arm halves are in the form of tubes that only need to be slipped onto the coupling piece and are bolted to the coupling piece. This type of design of the first main arm having the offset can thus be manufactured at relatively low cost.

BRIEF DESCRIPTION OF THE DRAWINGS

Further features and advantages of the invention will be apparent from the description below and from the accompanying drawings, to which reference is made and in which.

DETAILED DESCRIPTION

Figures 1, 2:
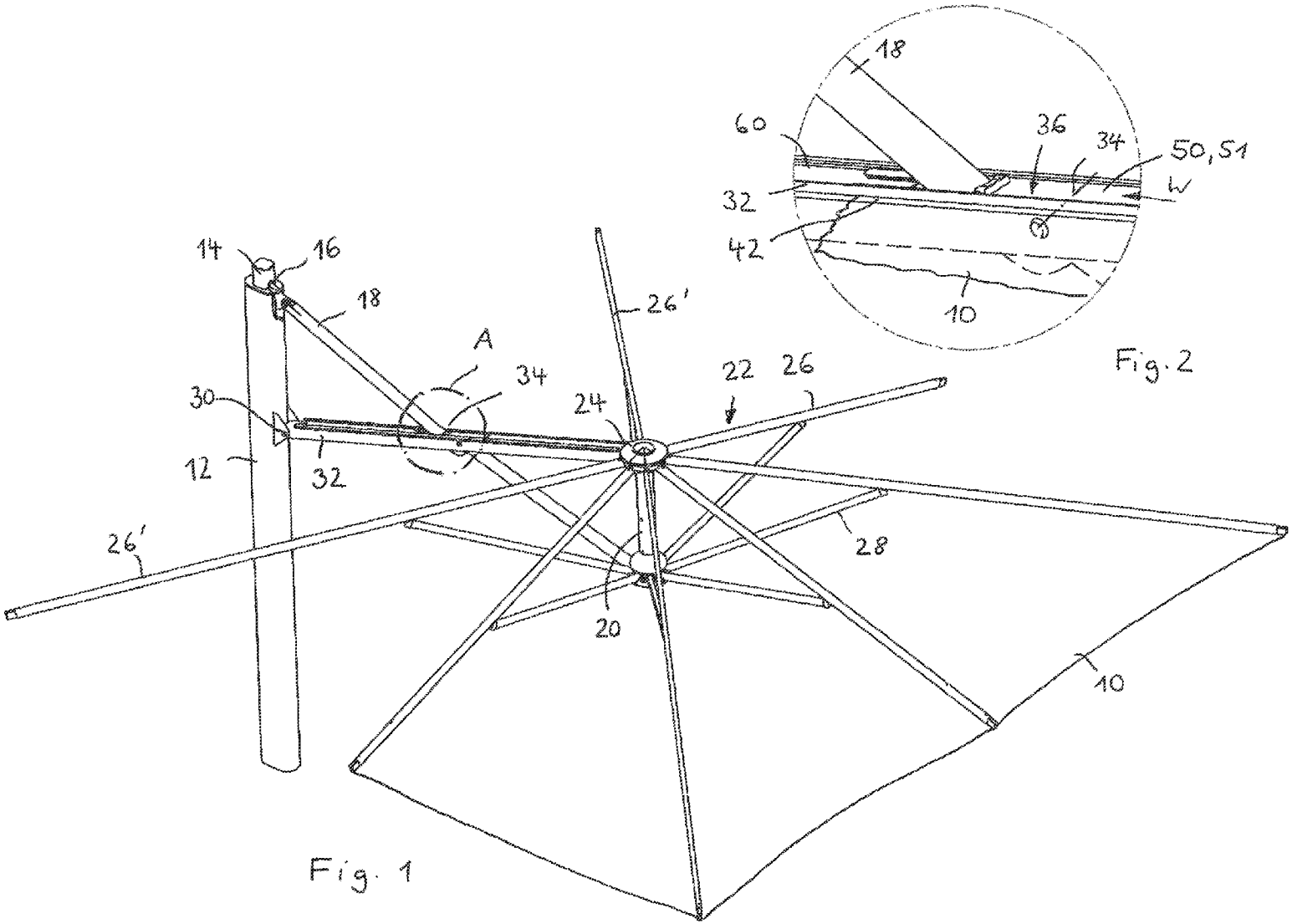
FIG. 1 shows the cantilever parasol according to the invention in the fully opened-up condition, partly without a cover.
FIG. 2 shows the detail A of FIG. 1 (in an enlarged view)

FIG. 1 illustrates a cantilever parasol which includes a cover 10 (only shown in part) and which may have a size of 4×4 m or larger. The cantilever parasol has a single mast 12 which is anchored in the ground or fastened on a stand.

The mast 12 is designed to be telescopic, which, however, should not be understood in a limiting sense, and comprises an extendable upper mast section 14. The mast section 14 has an upper mast bearing 16 for a first main arm 18 which in the opened-up condition, runs obliquely downward and which extends to a lower end of a vertical arm 20 of the frame 22. The vertical arm 20 is the center of the collapsible frame 22.

Cross struts 26 run outward and downward in a star shape from the so-called crown 24 of the frame 22. These cross struts 26 are stabilized by supports 28 which start from the lower end of the vertical arm 20 and which are swivel-mounted to the vertical arm 20 and to the cross struts 26. The cross struts 26 are also mounted to the vertical arm 20 for vertical swiveling motion.

A second main arm 32 extends obliquely upward (in the opened-up condition) from a lower mast bearing 30, which is preferably attached to the stationary part of the mast 12, to the crown 24, where it is swivel-mounted.

The position and the inclination of the second main arm 32 are preferably configured such that a cross strut 26 that should actually be provided on this side is replaced thereby. This means that the second main arm 32 preferably lies in the plane defined by the adjacent cross struts 26'. Since the cross struts 26, 26' rest against the underside of the cover 10, the cover 10 also rests against the second main arm 32.

The cantilever parasol can be folded up completely, more specifically to a condition in which the cross struts 26, 26' lie parallel or almost side by side and extend vertically. The main arm 32 also runs at least approximately vertically in the completely closed condition.

Figure 4:
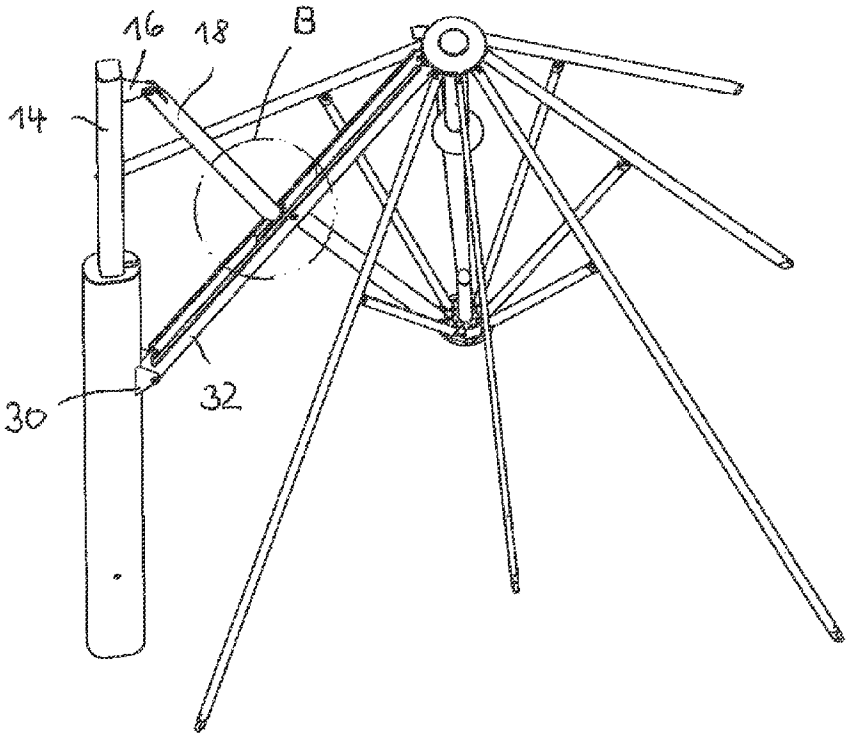
FIG. 4 shows the cantilever parasol according to FIG. 1, in a partially closed condition, without a cover.

FIG. 4 illustrates the cantilever parasol in a partially opened condition, with the extendable mast section 14 roughly half extended. For the completely folded-up position, the mast section 14 travels even further upward, whereas when the parasol is in the fully opened condition, it is almost completely received inside the stationary mast section (see FIG. 1).

The two main arms 18, 32 constitute a type of scissors linkage since they are coupled to each other for swiveling motion by a swivel bearing 34 (see also FIGS. 2 to 5). The second main arm 32 has a slit-shaped opening 36 (see FIGS. 2 and 3) for the passage of the first main arm 18. More particularly, the second main arm 32 is in the form of a rectangular tube, as is the first main arm 18.

To realize the opening 36, the tube forming the second main arm 32 includes gaps in sections in the upper and lower walls 70, 72 (see FIG. 3) or a slit in the upper and lower walls 70, 72. The swivel bearing 34 is attached to the side walls of the main arm 32 and extends through the main arm 18 (see FIGS. 1 to 3).

Figure 3:
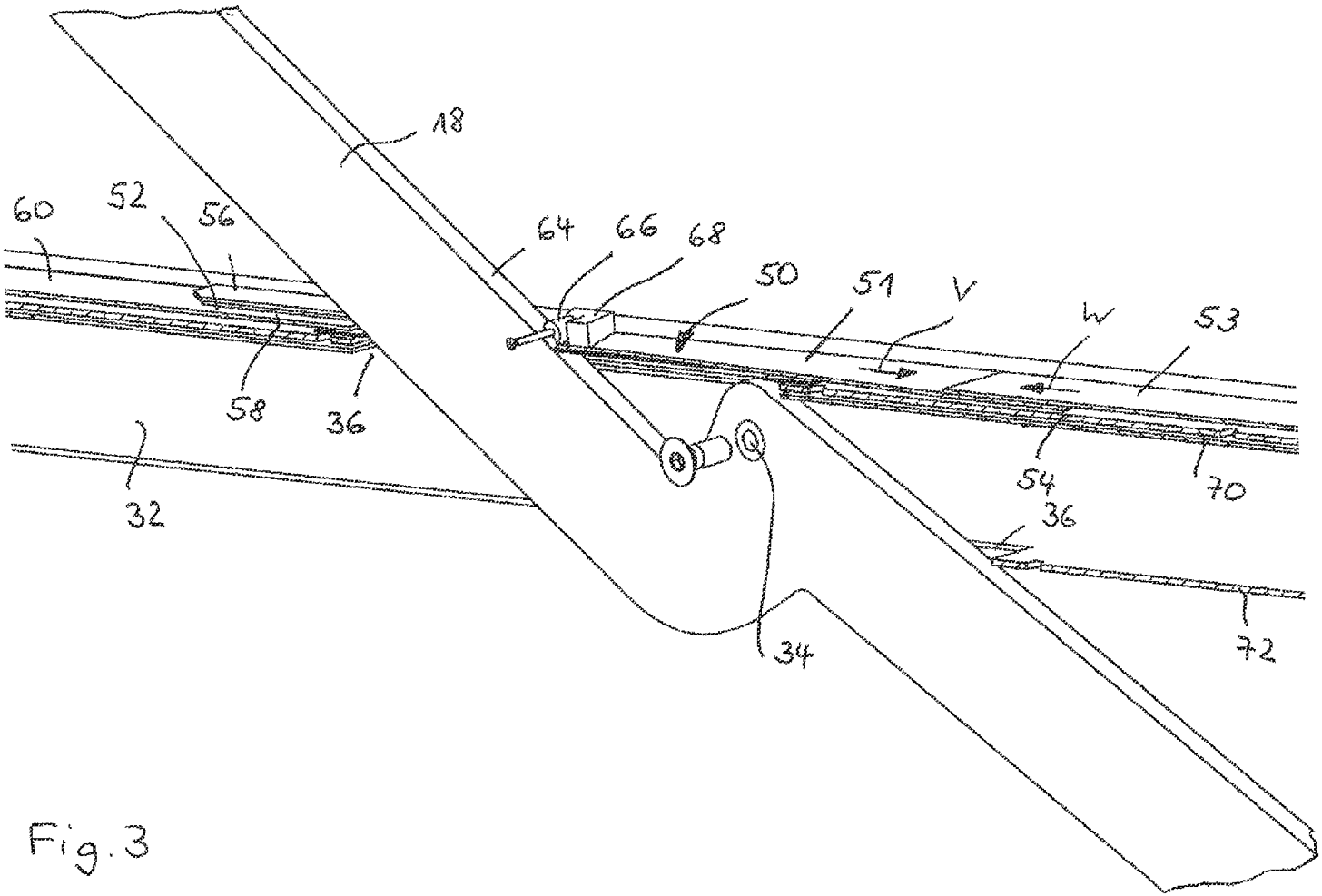
FIG. 3 shows a perspective longitudinal section taken through the two main arms, in the fully opened-up condition of the parasol.
Figure 5:
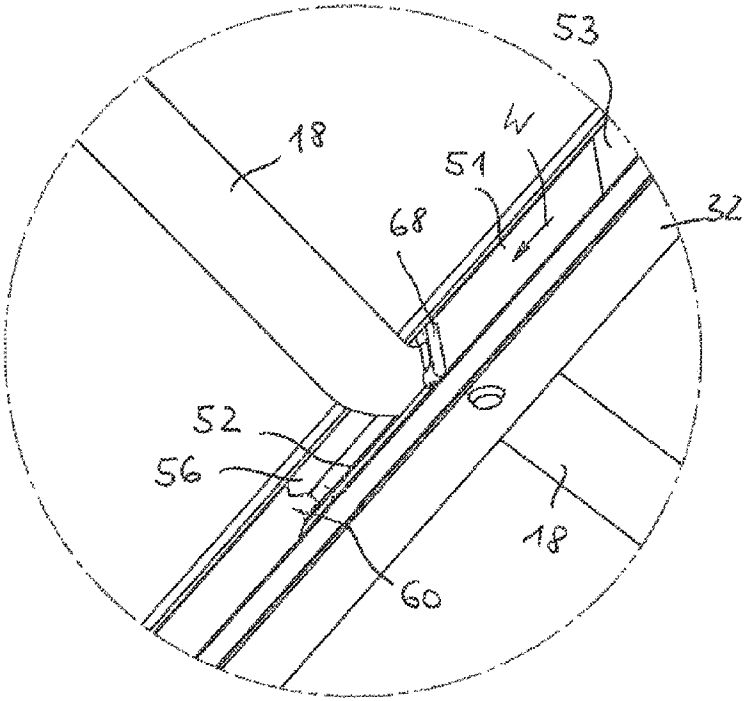
FIG. 5 shows the detail B of FIG. 4 (in an enlarged view)

The first main arm 18 is offset in the region of the swivel axis 34, as can be seen well in particular in FIGS. 3 and 5. One way of realizing this offset consists in placing two arm halves in the form of rectangular tubes onto a separate offset coupling piece and to bolt them thereto. The arm halves extend parallel and offset in relation to each other.

The first main arm 18 runs from above the cover 10 to the lower end of the frame 22 in the opened-up condition; it therefore passes through the cover 10. For this reason, the cover 10, relating to the opened-up condition, has a slit (see FIG. 2) which is located in the region of the swivel bearing 34 and runs along the second main arm 32 above and below the swivel bearing 34.

In FIG. 2 the cover 10 is visible, the edges 42 of the slit of the cover 10 being attached to the second main arm 32. This attachment may be provided either on the side walls, at the upper end of the side wall or else in the region of the upper wall 70 of the second main arm 32. Options for the attachment comprise, for example, hook-and-loop fasteners or clamping the edges 42 by strips, or by providing a weatherstrip on the edges 42 that locks in place in corresponding C-shaped rails or clip connections. Other possibilities of attachment may, of course, also be provided as desired. Preferably, the edges 42 are attached along the entire length of the edges 42 and not only at individual points, so as not to allow any leakages between the cover and the main arm 32, through which water might seep.

The slit in the cover 10 may extend either as far as to the outside edge of the cover 10 near the lower mast bearing 30 or only as far as shortly below the swivel bearing 34, relating to the opened-up condition, so that except for the short slit, the cover extends continuously.

In the following it will now be discussed how the parasol is made substantially rain-proof in the region of the slit of the cover 10 and the passage of the first main arm 18 through the second main arm 32.

The oblong opening 36 is closed by a sealing structure 50 in the form of at least one sealing plate 51 which is mounted at the second main arm 32 on the upper surface thereof so as to be axially displaceable. The sealing plate 51 includes a slit-shaped lead-through 52 which is adapted very closely to the dimensions of the first main arm 18, as can be seen in FIG. 5, for example. However, in order to allow the mobility and the various swivel positions of the main arms 18, 32, a certain play in the axial direction still needs to be available. Any slits or the like are closed by additional seals, in particular rubber seals, which are not shown here. These rubber seals may be applied to the sealing plate 51 and/or to the main arm 18 or 32.

The flattest position of the main arm 18 relative to the main arm 32 exists in the fully opened position of the parasol (see FIG. 3). The lead-through 52 has a length that is adapted to this extreme position and is only minimally longer than the passage length of the main arm 18 (as measured on the upper surface of the main arm 32 in the longitudinal direction thereof).

The sealing plate 51 may run, for example, in lateral rails on the main arm 32 or, as shown, in weatherstrip rails that are attached to the main arm, to be shifted along the main arm 32. In order not to allow any passage of water also above and below the sealing plate 51 between the latter and the rest of the main arm 32, as viewed in the longitudinal direction of the main arm 32, provision is made for a plurality of sealing plates that overlap in the nature of roof tiles in the longitudinal direction of the main arm 32. The displaceable sealing plate 51 forms the middle sealing plate of these sealing plates. An upper sealing plate 53 has a lower edge (again relating to the fully opened condition of the parasol) that overlies the upper edge 54 of the sealing plate 51, so that a sufficient overlap distance is given here (see FIG. 3).

The lower end 56 of the movable middle sealing plate 51 extends over an upper edge 58 of a lower sealing plate 60 (see FIGS. 2 and 3), so that a roof tile-type overlap is obtained. When the sealing plates 53 and 60 lie in the same guide and thus in the same plane, the middle sealing plate 51 is bent (see also FIG. 7).

The upper and lower sealing plates 53, 60 are preferably configured so as not to be longitudinally displaceable. As an alternative, it would, of course, also be conceivable that the lower sealing plate 60 is longitudinally displaceable and permanently rests against the main arm 18.

The sealing plates 53, 60 may be fitted as separate plates to the oblong opening 36 of the second main arm 32 to close the opening. Alternatively to this, the sealing plates 53, 60 or one of these two plates could also be part of the upper wall 70 of the main arm 32.

To prevent the water flowing down from the cover along the main arm 32 (water drain direction see arrow W) from flowing along the sealing plate 51 and subsequently down the main arm 18, it must be ensured that the sealing plate 51 rests against the upper surface 64 of the main arm 18 and follows the relative movement of the main arm 18 in relation to the main arm 32. The sealing plate 51 is coupled to the first main arm 18 in terms of motion, which is made possible by a coupling element in the form of a magnet 66 which is fastened on a bearing 68, for example, which is fixed in place on the sealing plate 51 (see FIG. 3).

One option of configuring the magnet 66 comprises providing a magnetic roller to obtain a rolling motion rather than a sliding motion. A different possibility comprises positioning the magnet 66 somewhat above and spaced apart from the main arm 18, so that the respective edge of the lead-through 52, which may possibly be configured to have a separate seal, always rests against the upper surface 64 of the arm 18 in a prestressed manner.

The sealing plate 51 itself or its coupling element, which is part of the sealing plate 51, moves along with the first main arm 18 during swiveling (see also arrow V in FIG. 3). FIG. 3 further shows the upper and lower walls 70 and 72 of the main arm 32, this, however, being only an exemplary embodiment. To increase the stability, a pair of upper walls and a pair of lower walls may possibly be provided. The side walls project somewhat over the upper wall 70, for example, to allow the sealing plates 51, 53 and 60 to be received and held; this, too, is just one possible embodiment.

In the fully opened position, the upper edge of the plate 60 sealingly engages the lower surface of the main arm 18. If the plate is adjustable for assembly, a fine adjustment can still be performed here. The end positions of the parasol thus also determine the length of the lead-through 52.

While in the embodiment described so far the sealing plate 51 includes a circumferentially open, slit-shaped lead-through 52 (see FIGS. 3 and 5) (that is, the slit-shaped lead-through 52 splits one half of the sealing plate 50 into two side legs, so that a kind of U is obtained), alternatively a circumferentially closed variant is possible. By the lower sealing plate 60 being pulled very closely to the lower surface of the main arm 18 or is likewise coupled to the main arm 18, no relevant slit is produced, even in the embodiment with the open slit, in the sealing plate 51. Also in this case, an additional seal, for example made from cellular rubber or the like, may of course or should of course be provided between the sealing plate 51 and the main arm 18.

The plate 60 may also have a bifurcated upper end which receives the arm 18 in between.

FIG. 5 shows that the sealing plate 51 has been shifted upward and under the sealing plate 53, as compared with the position according to FIG. 3. The sealing plate 60 is closely adjacent to the lower surface of the main arm 18. A cellular rubber may provide additional sealing in this area. As an alternative, it would also be possible to make the sealing plate 60 displaceable as well, so that one sealing plate 51 rests permanently against the upper surface 64 of the main arm 18 and one against the opposite lower surface of the main arm 18. In this intermediate position, the lead-through 52 may be open on the lower side of the arm 18, which, however, does not interfere with the operation since here no person stands below the parasol.

Figure 6:
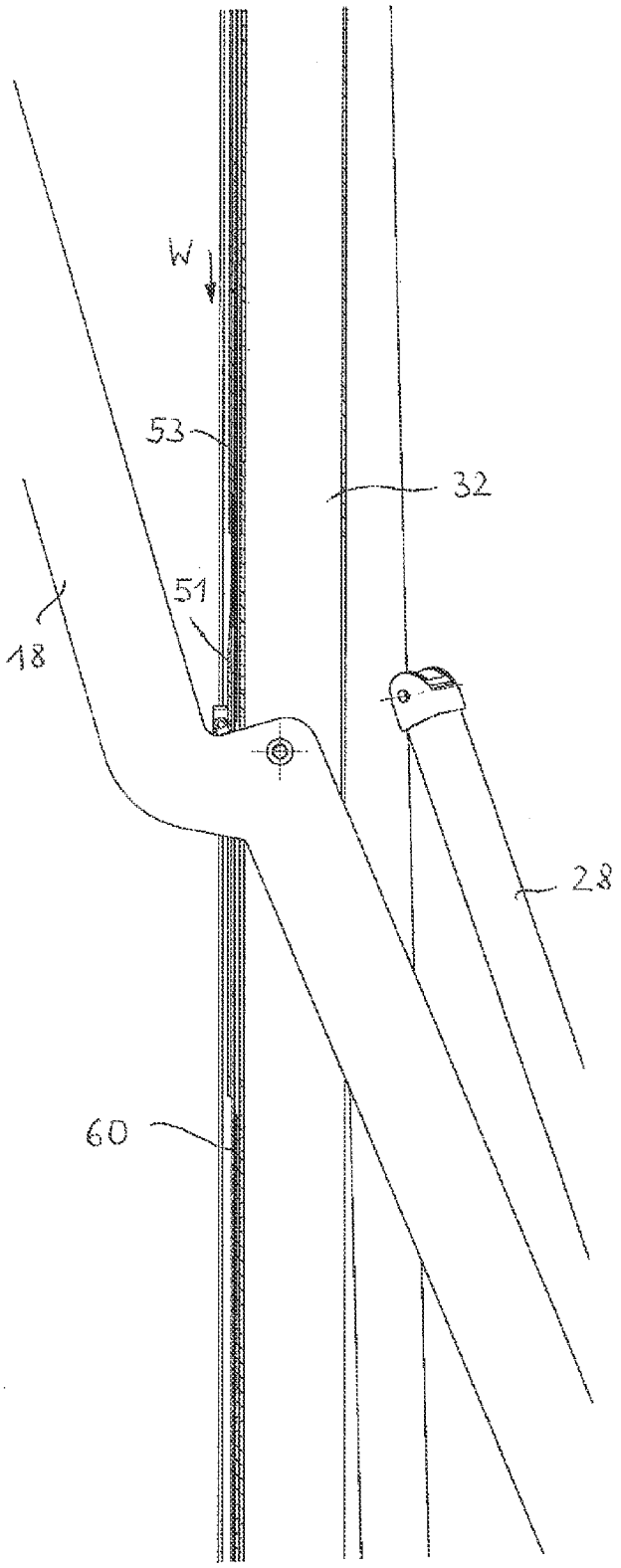
FIG. 6 shows a longitudinal section taken through the two main arms, with the parasol approximately completely closed.

Even in the completely closed position shown in FIG. 6, the sealing plate 51 still rests by its coupling element against the main arm 18.

Figure 7:
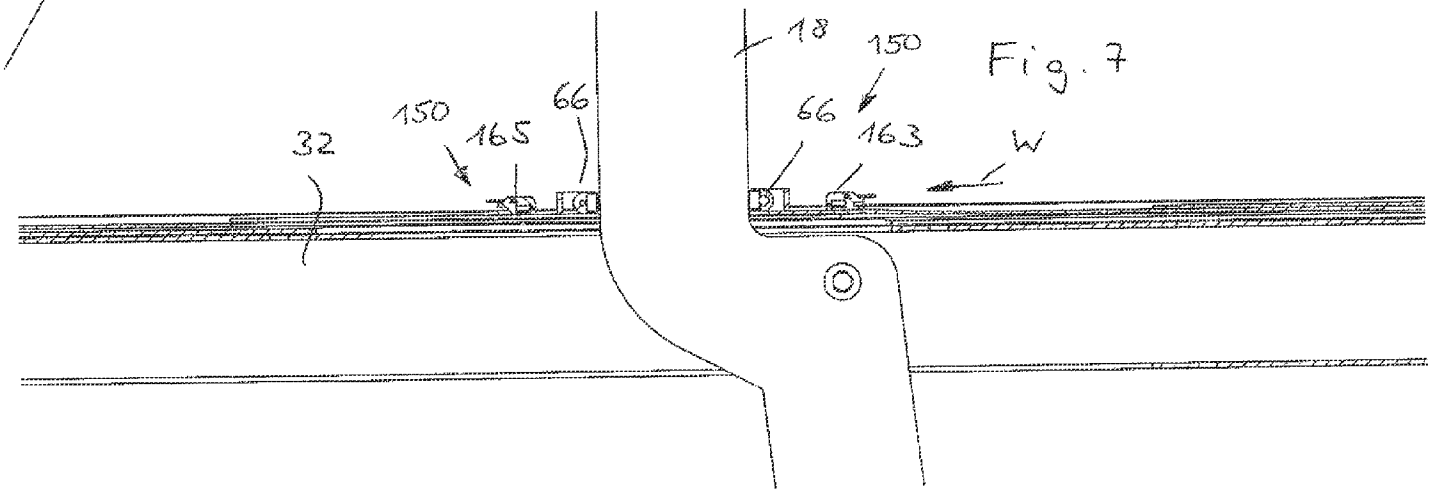
FIG. 7 shows a longitudinal section taken through the two main arms of an alternative embodiment, with the parasol partially closed, corresponding to FIG. 3.
Figure 8:
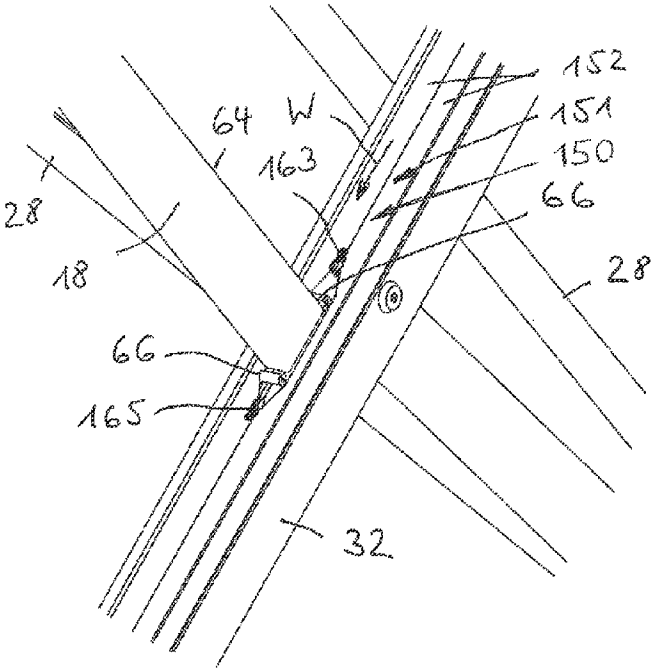
FIG. 8 shows a perspective detail view in the area of the swivel axis of the main arms according to the modified embodiment shown in FIG. 7.

FIGS. 7 and 8 illustrate an alternative embodiment of a sealing structure 150. In place of the sealing plate, a zipper 151 is provided here, the two edges 152 of which may be fitted, for example, to the edges 42 of the cover 10, which has been omitted in FIGS. 7 and 8 for better clarity.

In a simpler embodiment, provision is made for a slider 163 of the zipper 151 only on the upper side 64 of the main arm 18, the slider being connected with the main arm 18 via a coupling element (e.g., again with a magnet 66) and, by its relative movement, progressively closing the zipper toward the fully opened position.

Since the zipper 151 preferably extends along the side of the main arm 18 as far as over the lower side of the main arm 18 and further downward there along, it is conceivable to provide a slider 165 on the lower side of the main arm 18 as well, which is moved at the same time and opens or closes the zipper 151 on this side, as a result of which a very good sealing effect is obtained.

The zipper 151 is more particularly a toothless zipper having edges that allow a type of tongue-and-groove connection, such as with an airtight bag.

The position as shown in FIG. 7 of the main arms 18, 32 relative to each other with the cantilever parasol half open also corresponds to the position resulting in the embodiment according to FIGS. 1 to 6.

The invention claimed is:

1. A cantilever parasol comprising:

a mast;

first and second main arms proceeding laterally from the mast and coupled to each other in a scissor configuration;

a fold-open linkage of bars that is seated eccentrically of the mast to support a cover, wherein the first main arm extends, in an opened-up condition of the parasol, from an upper mast bearing through a slit in the cover and obliquely downward to a vertical arm seated in a center of the cover such that the vertical arm forms part of the linkage of bars, and wherein the second main arm runs from a lower mast bearing below the cover toward a crown thereof; and at least one sealing structure coupled to at least one of the main arms to seal the slit in the cover, wherein the at least one sealing structure is guided for sliding motion on the second main arm and is displaced during opening and closing of the parasol.

2. The cantilever parasol according to claim 1, wherein the sealing structure is coupled to the first main arm in terms of motion and is displaced by swiveling the first and second arms.

3. The cantilever parasol according to claim 2, wherein the sealing structure permanently rests against the first main arm.

4. The cantilever parasol according to claim 2, wherein a coupling element is provided to connect the sealing structure with the first main arm.

5. The cantilever parasol according to claim 4, wherein the coupling element comprises at least one magnet.

6. The cantilever parasol according to claim 1, wherein the second main arm has an oblong opening for the first main arm to extend therethrough.

7. The cantilever parasol according to claim 1, wherein edges of the slit of the cover are attached to the second main arm.

8. The cantilever parasol according to claim 1, wherein the at least one sealing structure is a zipper, and wherein a slider of the zipper is coupled in terms of motion to the first main arm.

9. The cantilever parasol according to claim 8, wherein the zipper comprises a toothless zipper.

10. The cantilever parasol according to claim 1, wherein the first main arm is offset in a region of a respective swivel axis via which the first main arm it is connected to the second main arm for swiveling motion, so that two parallel arm halves are formed.

11. A cantilever parasol comprising:

a mast;

first and second main arms proceeding laterally from the mast and coupled to each other in a scissor configuration;

a fold-open linkage of bars that is seated eccentrically of the mast to support a cover, wherein the first main arm extends, in an opened-up condition of the parasol, from an upper mast bearing through a slit in the cover and obliquely downward to a vertical arm seated in a center of the cover such that the vertical arm forms part of the linkage of bars, and wherein the second main arm runs from a lower mast bearing below the cover toward a crown thereof; and at least one sealing structure coupled to at least one of the main arms to seal the slit in the cover, wherein the at least one sealing structure includes at least one sealing plate.

12. The cantilever parasol according to claim 11, wherein the at least one sealing plate has a slit-shaped lead-through for the first main arm.

13. The cantilever parasol according to claim 11, wherein the at least one sealing plate comprises a movable sealing plate that overlaps with adjacent upper and lower sealing plates, relating to the opened-up condition, and in an imbricated fashion.

* * * * *